US006588453B2

(12) United States Patent
Marty et al.

(10) Patent No.: US 6,588,453 B2
(45) Date of Patent: Jul. 8, 2003

(54) ANTI-WOBBLE SPRAY HEAD FOR PULL-OUT FAUCET

(75) Inventors: Garry R. Marty, Fishers, IN (US); Darrell S. Crowe, Lebanon, IN (US); David M. Hardesty, Osgood, IN (US)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 09/858,051

(22) Filed: May 15, 2001

(65) Prior Publication Data

US 2002/0170608 A1 Nov. 21, 2002

(51) Int. Cl.[7] ..... E03C 1/04
(52) U.S. Cl. ..... 137/801; 4/678; 239/588
(58) Field of Search ..... 4/678; 137/801; 239/588

(56) References Cited

U.S. PATENT DOCUMENTS 5,934,325 A * 8/1999 Brattoli et al. ..... 137/801
6,220,297 B1 * 4/2001 Marty et al. ..... 137/801

* cited by examiner

*Primary Examiner*—Gerald A. Michalsky
(74) *Attorney, Agent, or Firm*—Carlson, Gaskey & Olds

(57) ABSTRACT

In a pull-out spray head faucet or hand shower an insert is disposed in the tube spout to keep the pull-out spray head or wand from wobbling when it is seated in the tube spout. The insert is generally tubular and is shaped and sized to fit into the tube spout. The insert has two opposed tabs on the interior walls which engage two wings on an adapter which is mounted in the wand, thereby securing the adapter and wand against wobble.

16 Claims, 12 Drawing Sheets

ANTI-WOBBLE SPRAY HEAD FOR PULL-OUT FAUCET

FIELD OF THE INVENTION

The instant invention relates to faucets or showers having pull-out spray heads or wands, particularly to faucets having pull-out spray heads wherein the pull-out spray heads are securely and firmly seated in the spout or hub with reduced play or wobble.

BACKGROUND OF THE INVENTION

Faucets or showers having pull-out spray heads are well known. The use of kitchen and lavatory faucets with pull-out spray heads has become more widespread. In these faucets or showers the pull-out spray heads or wands are normally seated in the spout or hub of the faucet. Generally, an adapter which is mounted in and extends rearwardly for a short distance out of the handle of the wand is inserted into the hub. The adapter receives the hose and, unless it is formed to be sized just right, it generally does not fit perfectly and tightly into the hub. This results in there being some vertical play or wobble in the adapter and in the wand in which it is disposed. Also, the wand does not fit flush into the hub, and there is an unsightly space between the wand and the hub at the top of the junction of the hub and wand. The present invention remedies this problem.

SUMMARY OF THE INVENTION

According to the present invention an insert is provided in the tube spout which receives the adapter which is mounted in the pull-out spray head or wand of a pull-out faucet or hand shower. This keeps the wand from wobbling when the wand is inserted into and seated in the tube spout. The insert is comprised of a tubular member sized to fit into the tube spout. The insert has a pair of interior angled tabs that cooperate with corresponding mating wings on the adapter which is seated in the wand. The angled tabs engage with the mating wings on the adapter and force the adapter down thereby more securely retaining the adapter in the insert.

DESCRIPTION OF THE PREFERRED EMBODIMENTS

Figure 1:
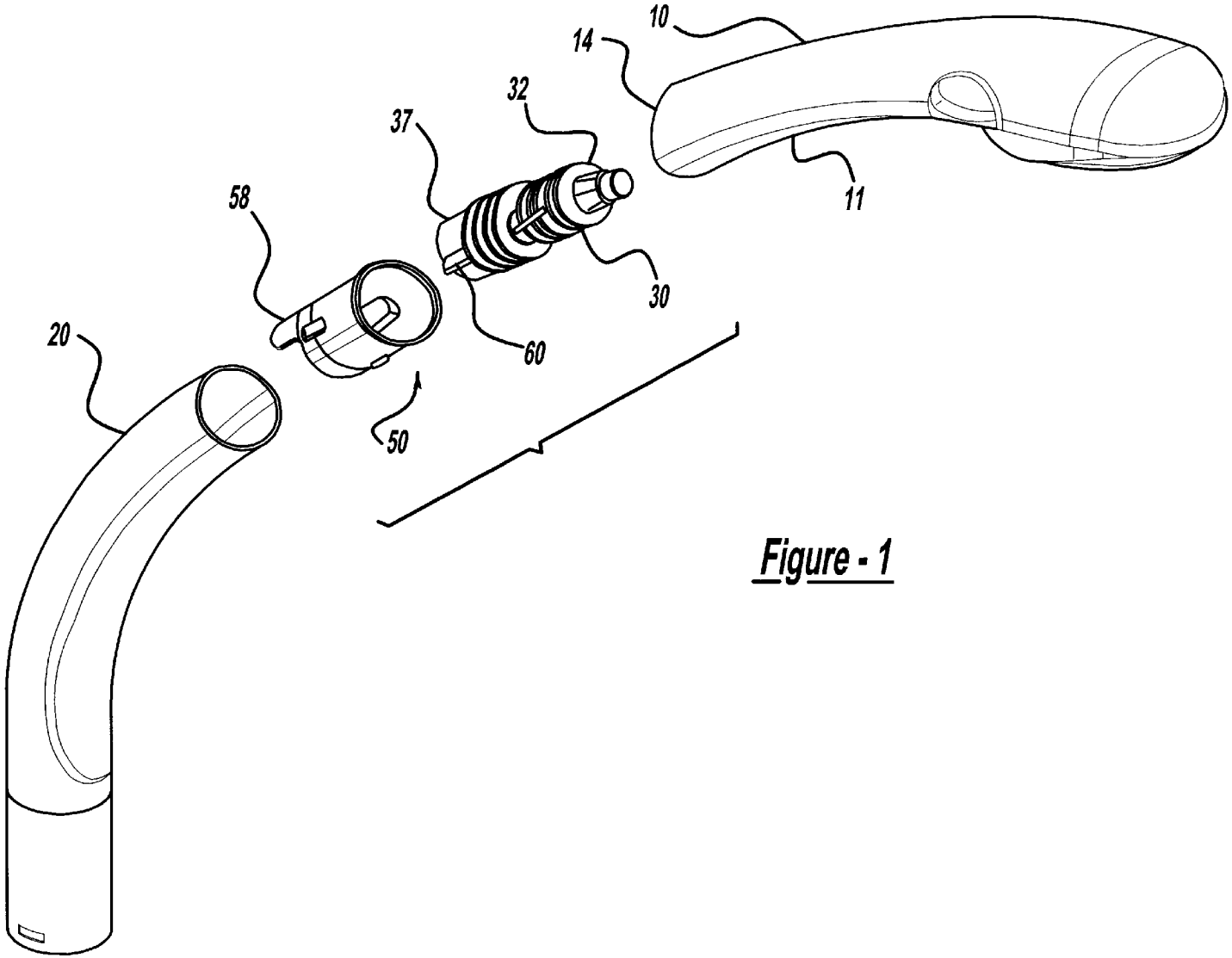
FIG. 1 is an exploded perspective view showing the pull-out spray head or wand, adapter, insert and tube spout.
Figure 2:
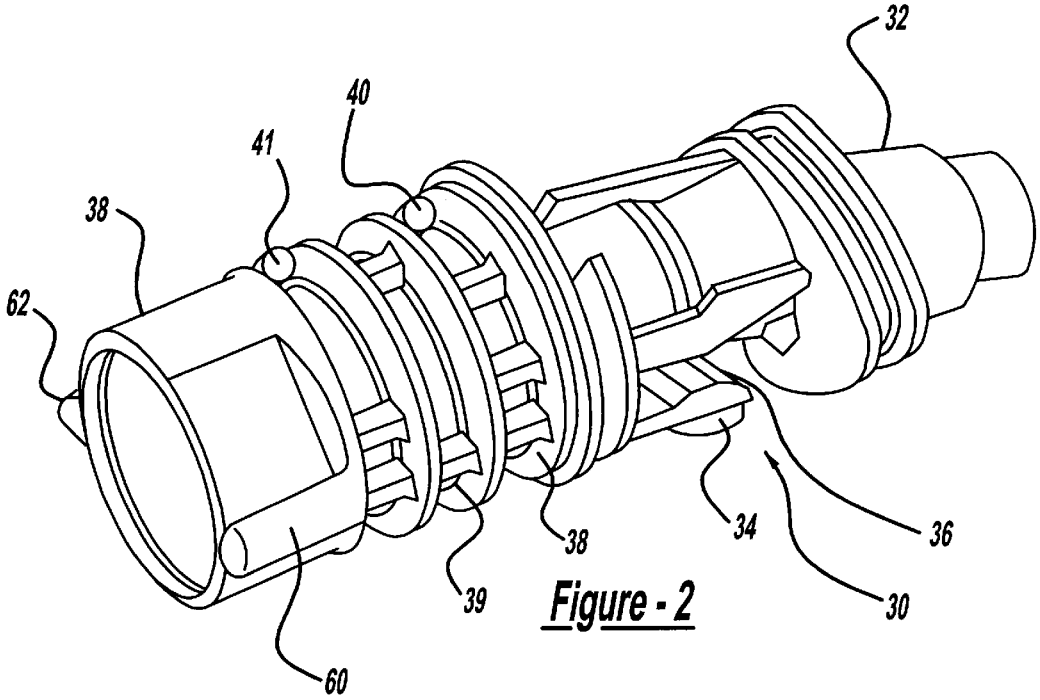
FIG. 2 is a top perspective view of the adapter.
Figure 3:
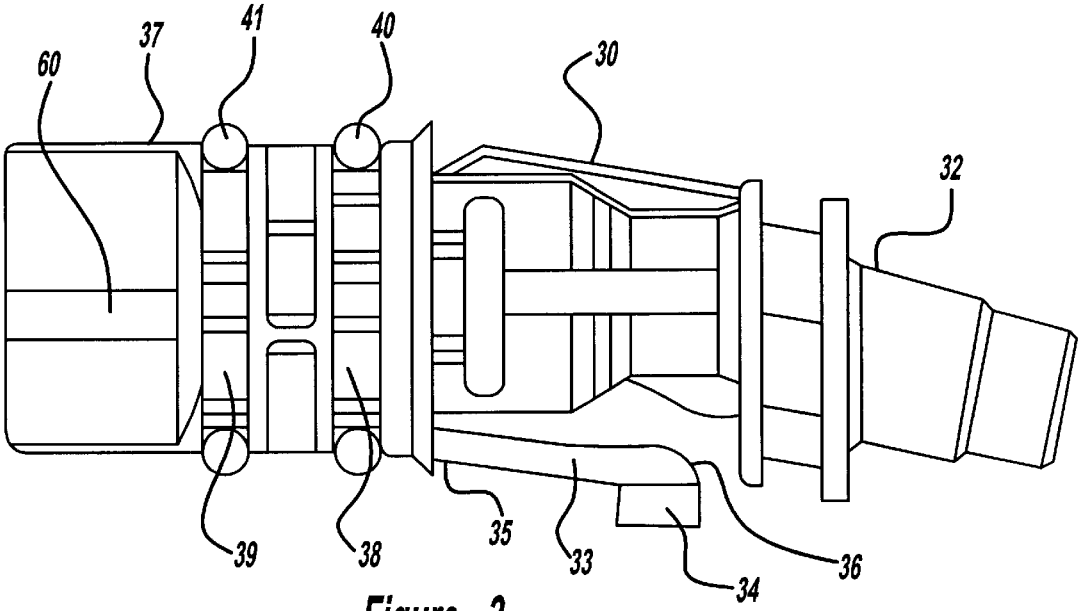
FIG. 3 is a side elevational view of the adapter.
Figure 4:
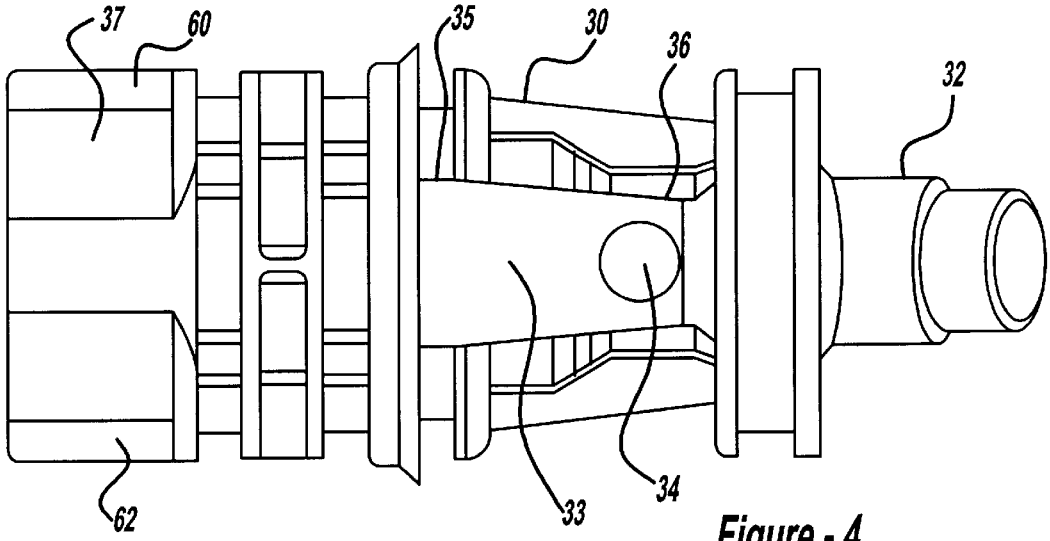
FIG. 4 is a bottom plan view of the adapter.
Figure 5:
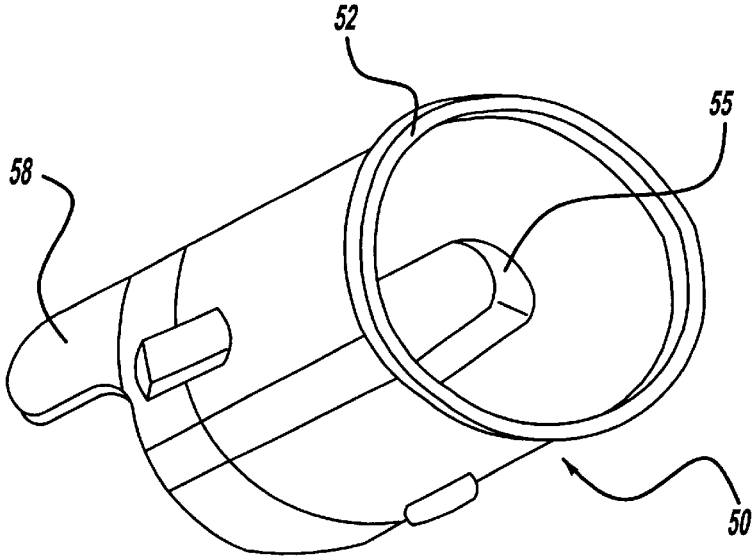
FIG. 5 is a front perspective view of the insert.
Figure 6:
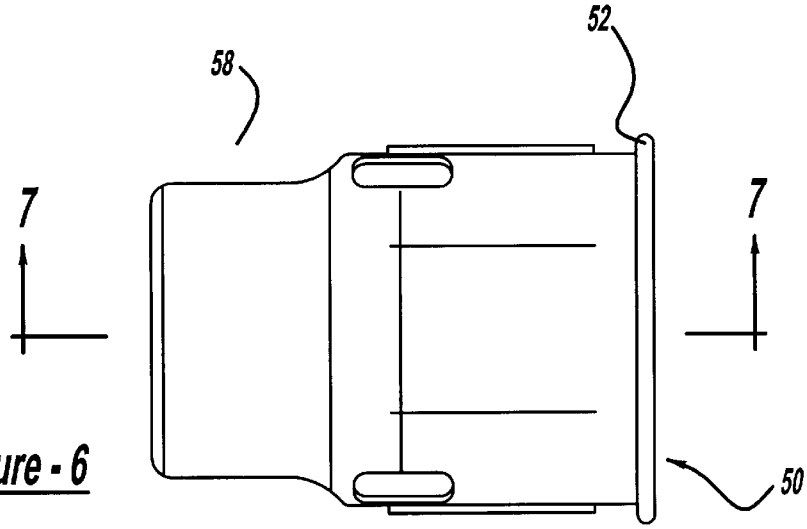
FIG. 6 is a top plan view of the insert.
Figure 8:
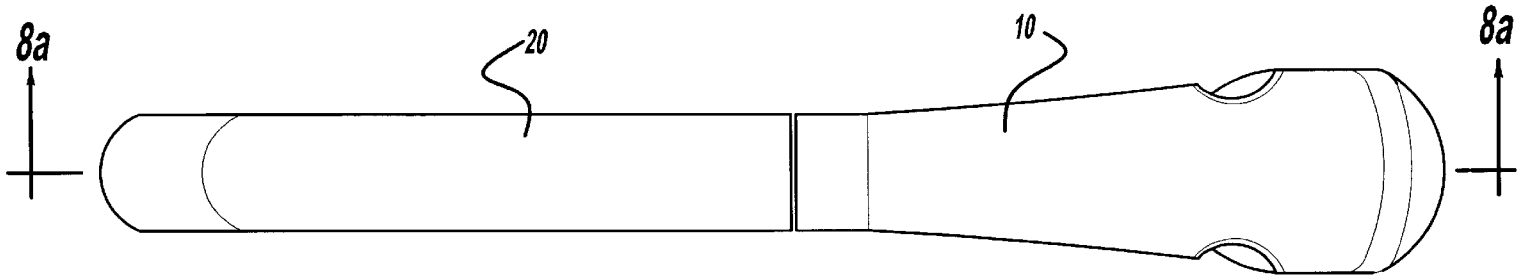
FIG. 8 is a top plan view of the pull-out spray head or wand inserted into the tube spout.
Figure 8A:
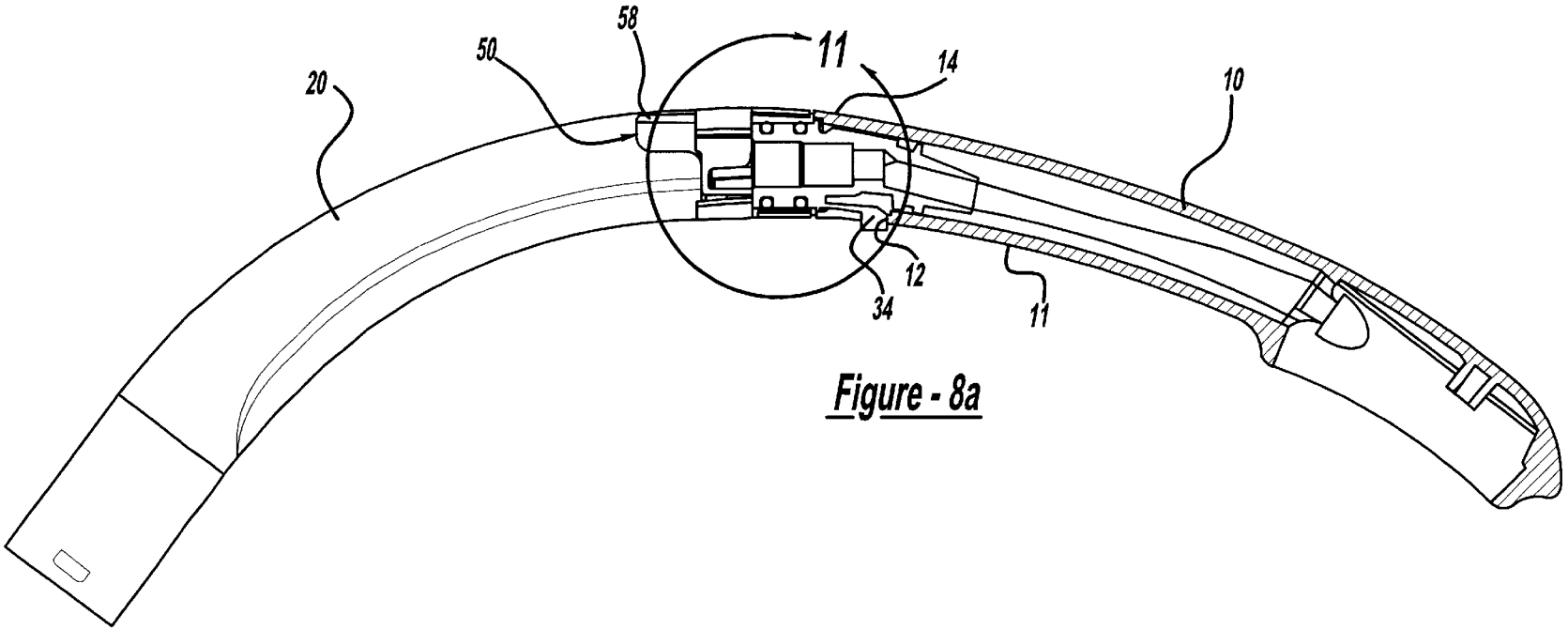
FIG. 8*a* is a side sectional view taken along line 8*a*—8*a* in FIG. 8 showing the pull-out spray head fully inserted into the tube spout.
Figure 8B:
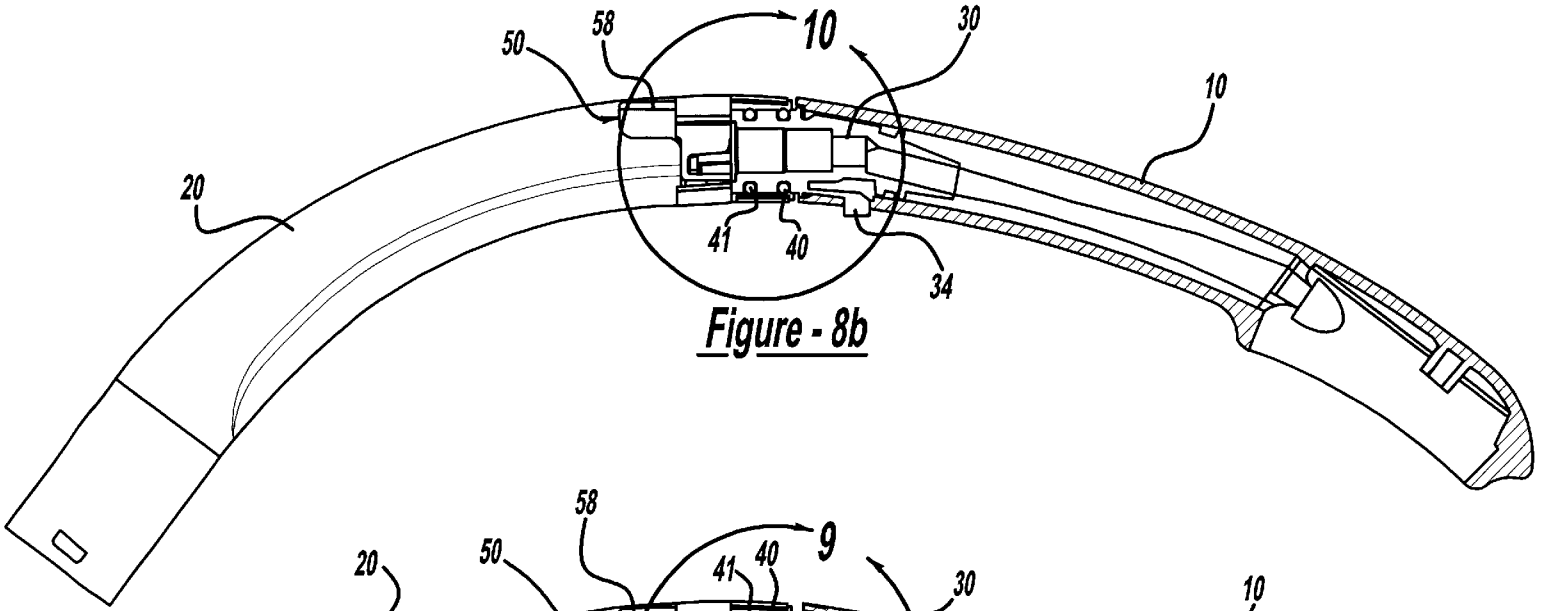
FIG. 8*b* is a view similar to FIG. 8*a* showing the adapter and insert but with the spray head only partially inserted into the tube spout.
Figure 8C:
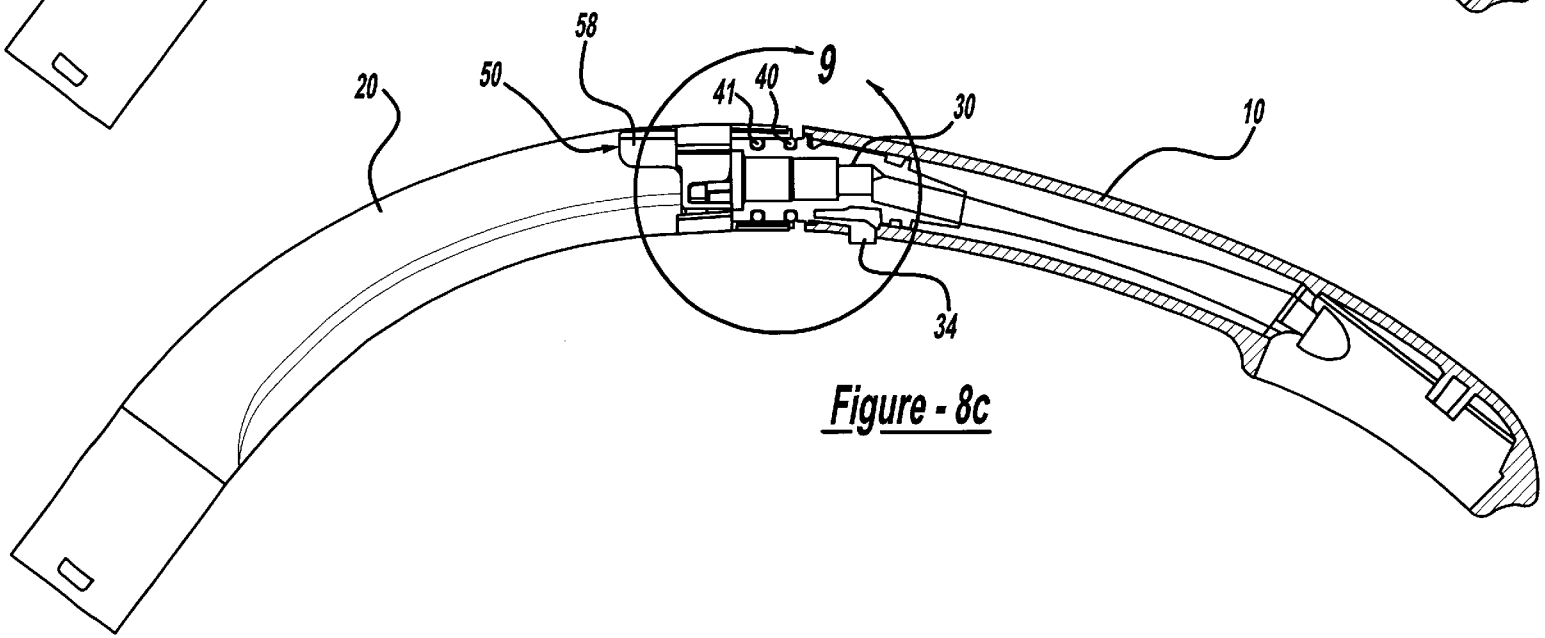
FIG. 8*c* is a view similar to FIG. 8*b* but with the spray head further out of the tube spout than in FIG. 8*b;*
Figure 9:
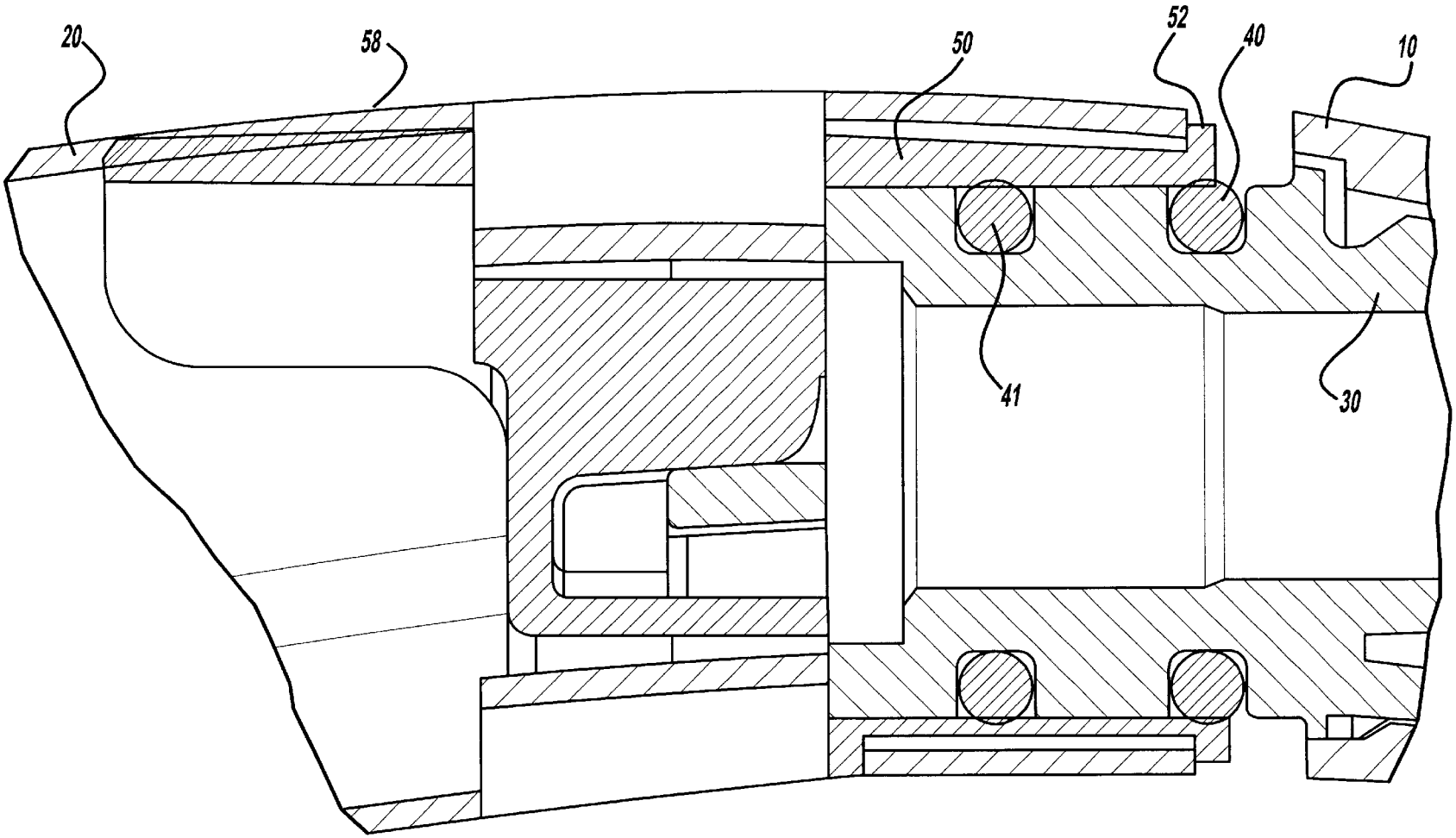
FIG. 9 is an enlarged, side sectional view taken along line 9 in FIG. 8*c* showing the adapter in the insert.
Figure 10:
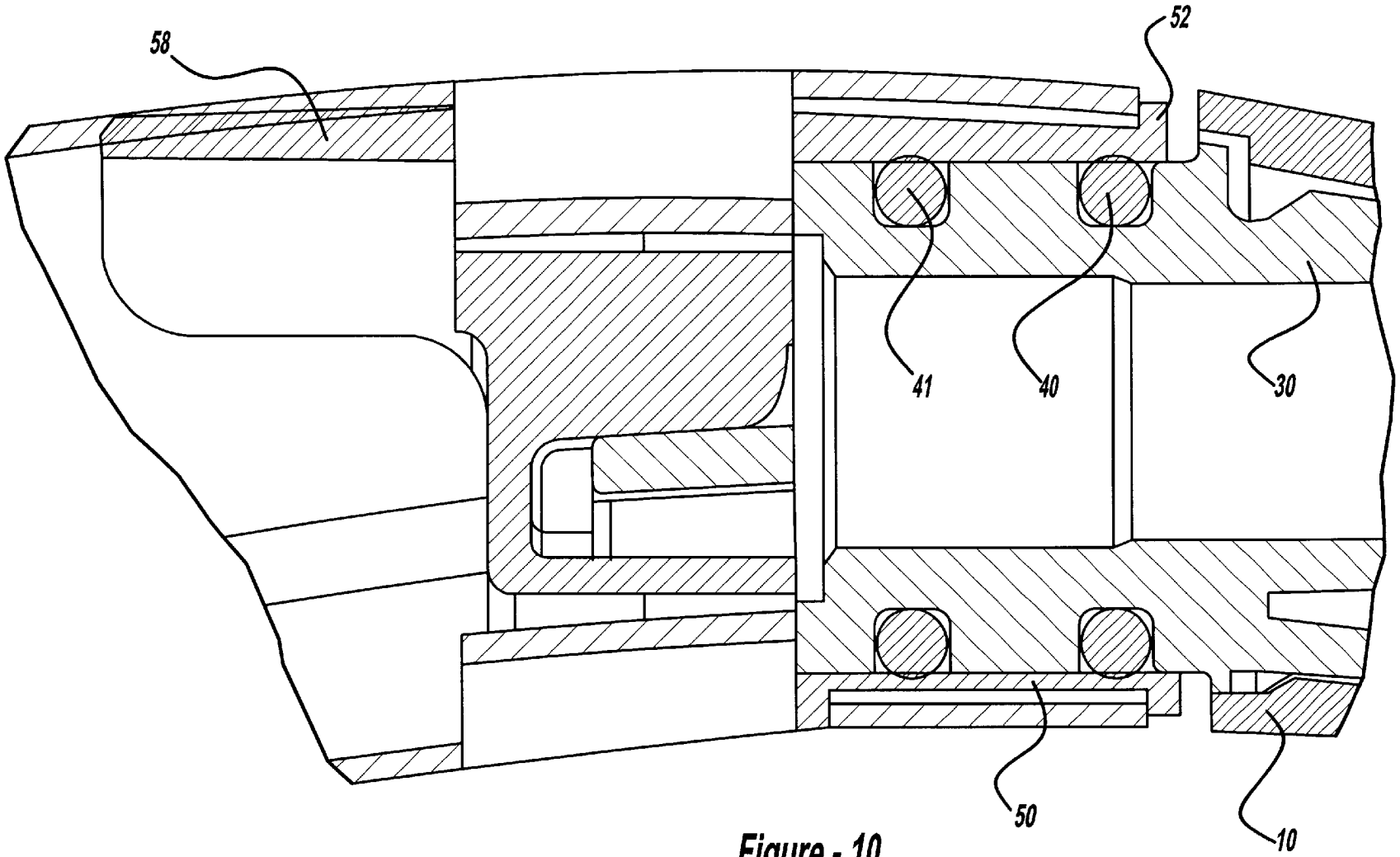
FIG. 10 is an enlarged, side sectional view taken along line 10 in FIG. 8*b* showing the adapter in the insert.

The insert 50 of the instant invention is utilized to stabilize and prevent or reduce wobble or playoff a pull-out spray head or wand 10 when it is inserted into a tube spout 20. More specifically, an adapter 30 is mounted in the wand 10 as best seen in FIGS. 8*a*–8*c*. The adapter may be comprised of any suitable material, e.g., metal such as copper, brass, steel or plastic. The adapter 30 is comprised of a front end 32 and a back end 37. As best illustrated in FIGS. 3 and 4 the adapter 30 has a forwardly extending flexible finger 33 having a downwardly projecting button 34 at its front end 36. The finger 33 is located at the bottom of the adapter and is free or unattached at its front or forward end 36. At its back end 35 the finger 33 is attached to the adapter 30. As illustrated in FIGS. 8*a*–8*c* the button 34 fits into a complementary shaped opening 12 in the bottom 11 of the wand near the rear or back 14 of the wand and retains or locks the adapter 30 in the wand 10.

The rear of the adapter 37 has two grooves 38, 39 in which are seated O-rings 40,41. There are also two outwardly extending protrusions or wings 60, 62 on opposite sides at the rear of the adapter 30 to the rear or downstream of grooves 38, 39. The rear 37 of the adapter 30 extends rearwardly out of the wand 10 and is shaped to fit into the insert 50.

Figure 7:
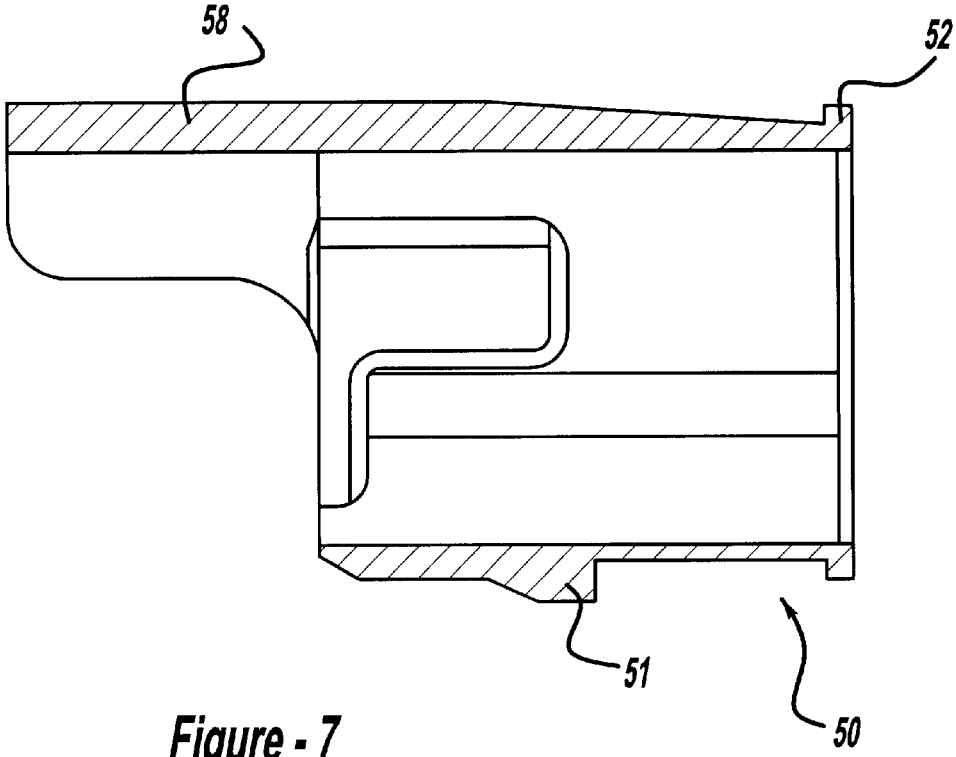
FIG. 7 is a sectional view of the insert taken along line 7—7 of FIG. 6.
Figure 7A:
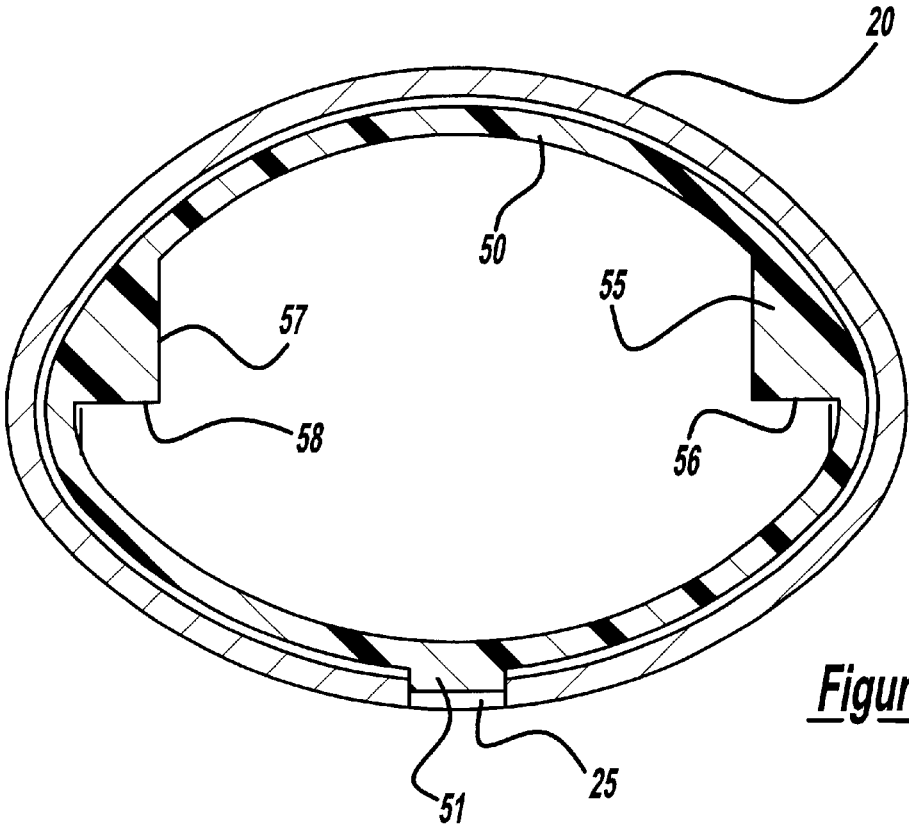
FIG. 7*a* is a front cross-sectional view of the insert disposed in the tube spout.

The insert 50, as best shown in FIGS. 5–7*a*, is a hollow generally tubular member. Insert 50 is sized and shaped to fit into tube spout 20. In one embodiment, as best illustrated in FIG. 7*a*, the insert 50 has a substantially elliptical cross-section. In the interior of the insert 50 are disposed two tabs 55, 57. The tabs 55, 57, as best seen in FIG. 7*a*, are disposed on opposite side walls of the insert 10. In one embodiment at least the bottom surfaces 56, 58 of the tabs 55, 57 are angled. 60,62 on the adapter 30 engage with the tabs 55, 57, more particularly with the angled bottom surfaces 56, 58 of the insert, which forces the adapter 30 in a downward direction. This reduces wobble as there is no or little clearance between two of the surfaces.

The O-rings 40, 41 in the adapter serve, inter alia, to provide a good, snug fit between the adapter 30 and the insert 50, and to minimize wobble or play even more. The front O-ring 40 is centered to provide a consistent fit with the insert 50 while the adapter forces the bottom portion of the O-ring further than is the case with a typical seal. This provides an upward load between tabs 55, 57 and wings 60,62 provides stability and minimizes wobble. More particularly, the wings 60,62 of angled tabs 55, 57 force the entire wand 10, including the adapter 30, downward compressing the bottom half of the O-rings 40, 41 while reducing the squeeze or compressive force on the top part of the O-rings 40, 41. This has a line-to-line fit on the wings 60,62 with increase loading on the lower section of the O-rings 40, 41 to minimize droop. Because this results in only one direction for a gap the wobble is greatly reduced.

Located on the bottom of insert 50 is a downwardly projecting button 51. As best illustrated in FIG. 7*a* button 51 fits into an aperture 21 in the bottom of tube spout 20 and helps to retain and properly locate insert 50 in tube spout 20.

Figure 11:
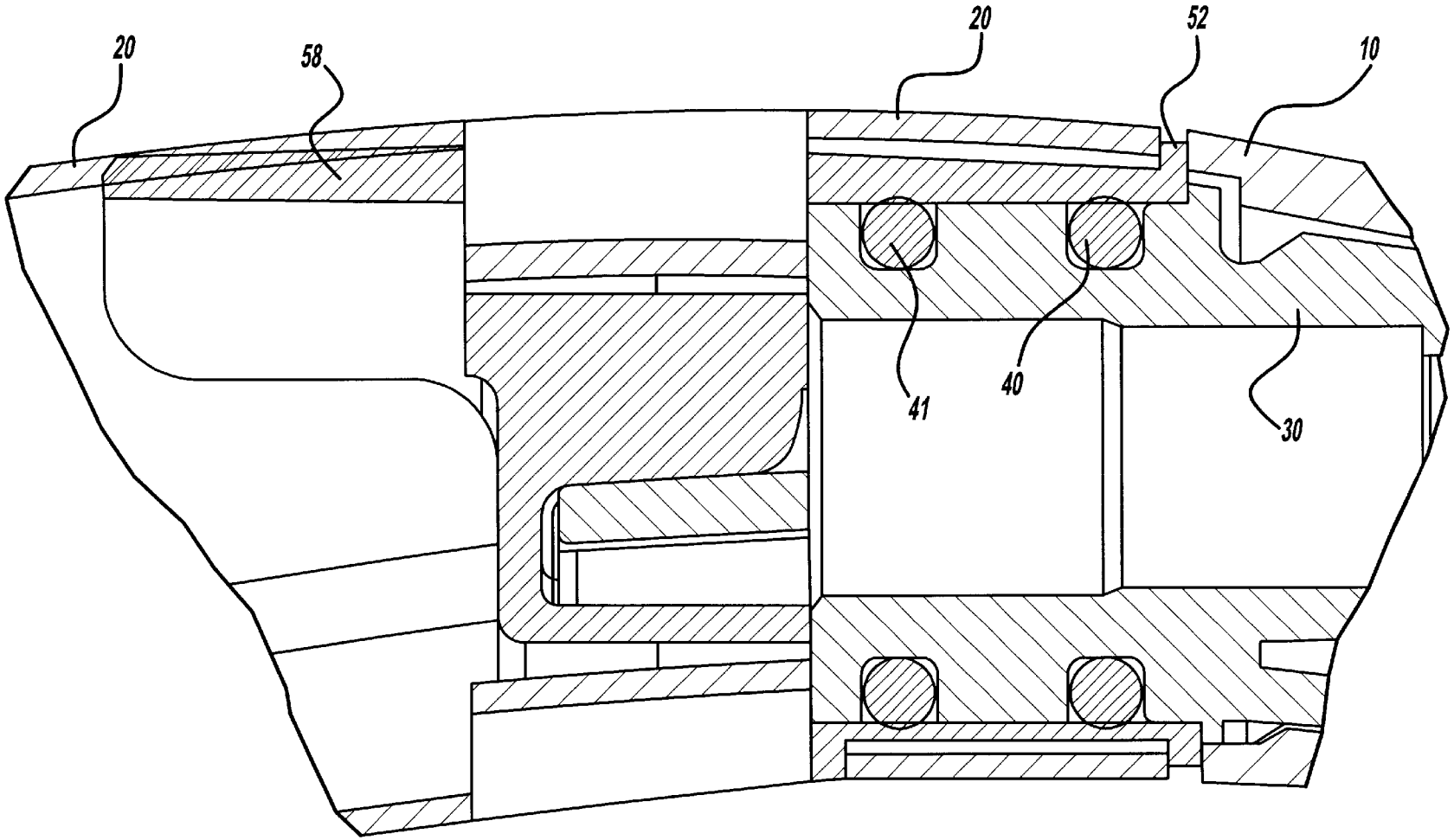
FIG. 11 is an enlarged, side sectional view taken along line 11 in FIG. 8*a* showing the adapter in the insert.
Figure 12:
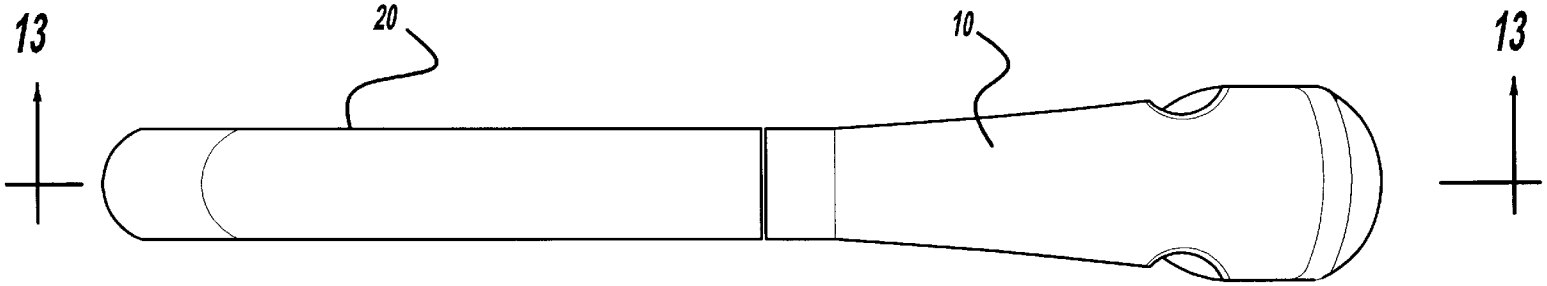
FIG. 12 is a top plan view of the pull-out spray head inserted into the tube spout.
Figure 13:
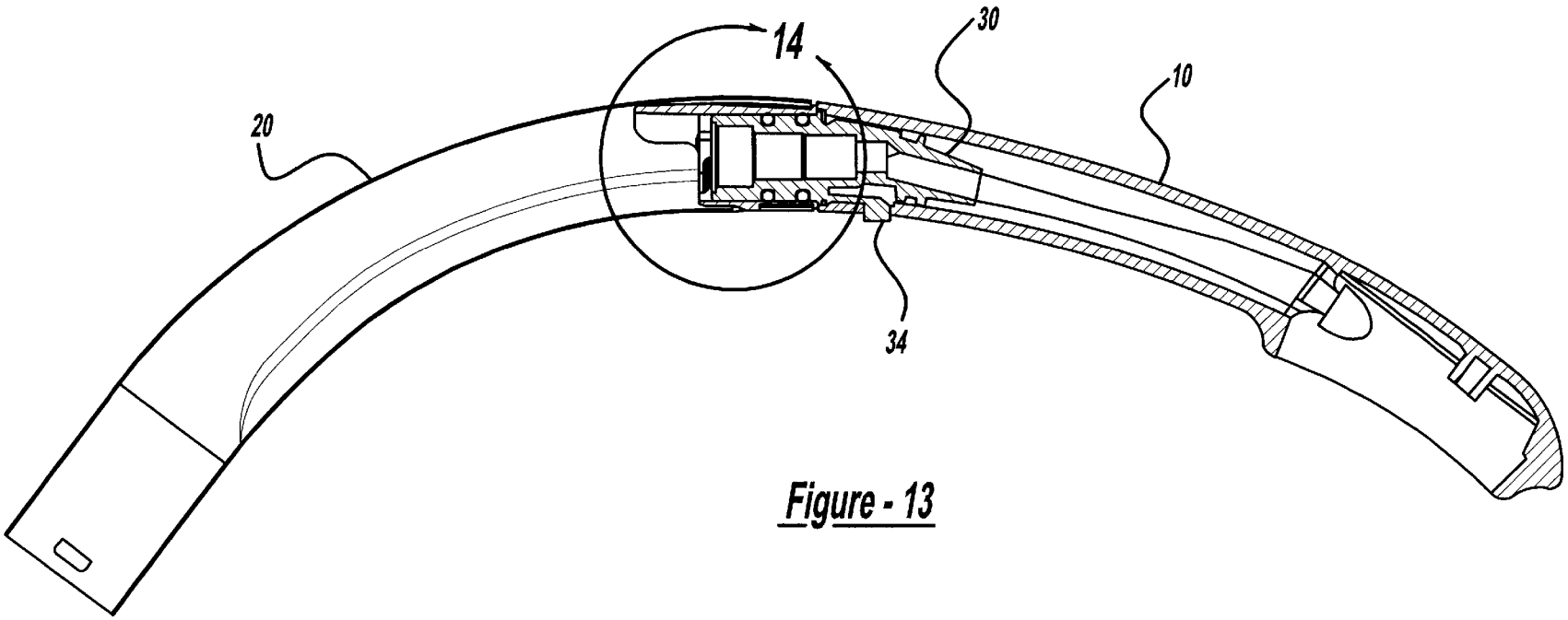
FIG. 13 is a side sectional view of the pull-out spray head fully inserted into the tube spout.

At the front of the insert is a circumferentially extending lip 52. As best illustrated in FIG. 11 the lip 52 extends radially from the front of insert 50 sufficiently to come between tube spout 20 and wand 10.

Figure 14:
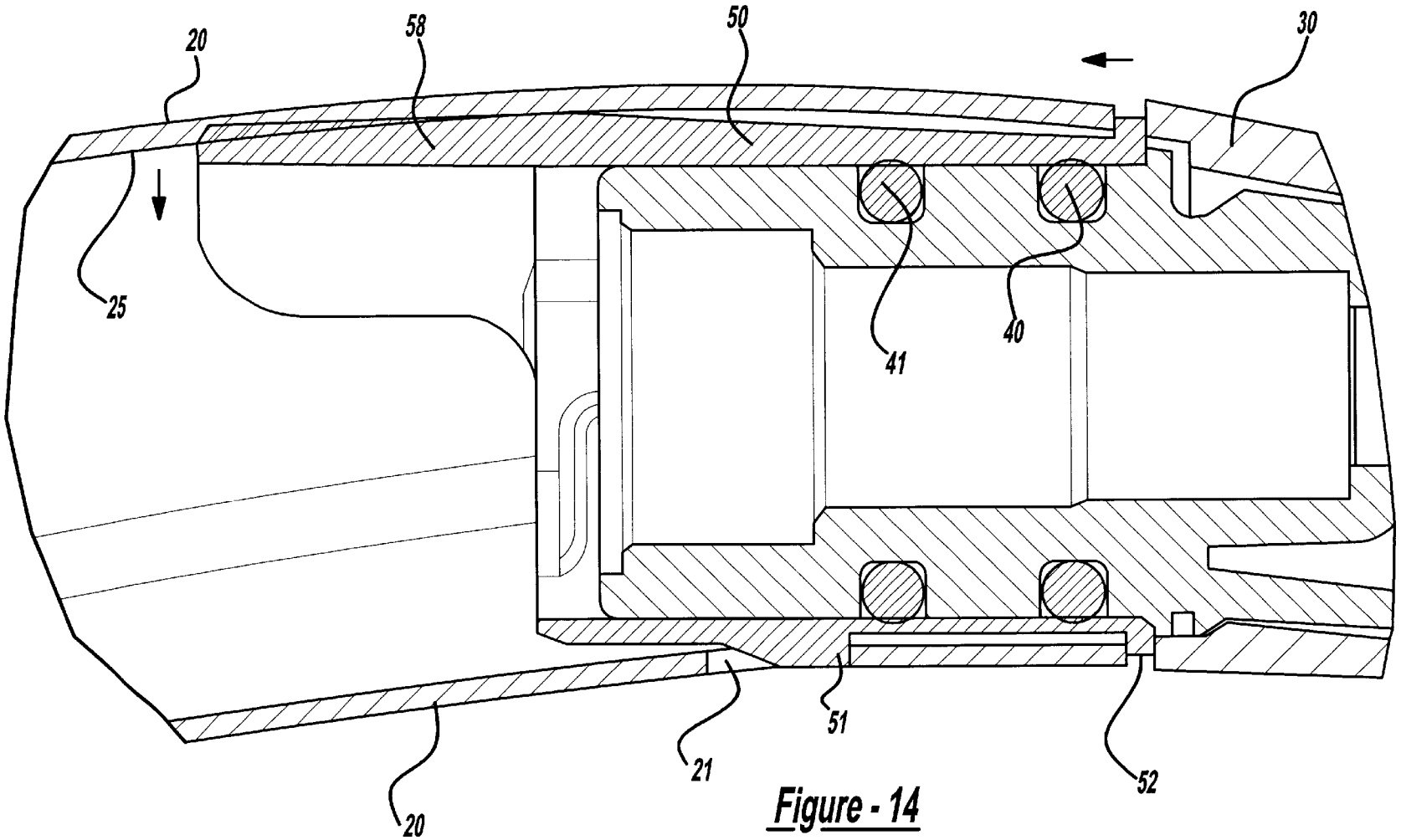
FIG. 14 is an enlarged, side sectional view taken along line 14 in FIG. 13 showing the adapter fully in the insert.

In one embodiment of the insert 30, as illustrated in FIGS. 1, 5–7, 8*a*–11, 13 and 14, there is a tab extension 58 provided at the top rear of insert 50. This tab extension 58 engages the inside top surface 25 of the tube spout 20. This forces button 51 into aperture 25 on the underside of tube spout 20. This is best illustrated in FIG. 14. This embodiment eliminates the need for adhesives applied on the insert 50 to keep the insert in the tube spout 20.

Figure 15:
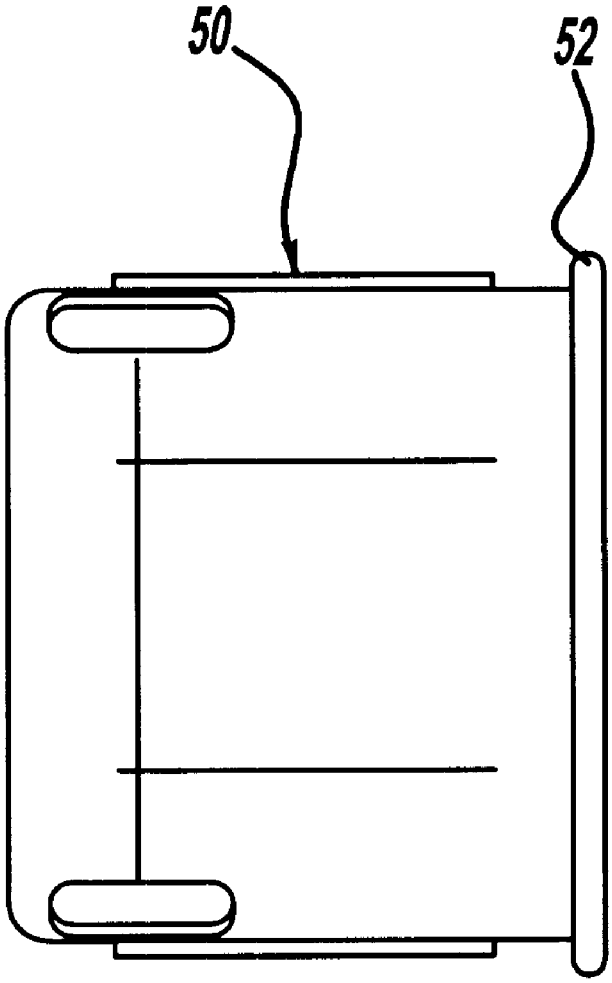
FIG. 15 is a top plan view of a second embodiment of the insert. In this embodiment the insert has no spring extension tab.

In another embodiment, as illustrated in FIG. 15, the insert 30, does not have a tab extension 58. In this embodiment there may be a need for adhesives to keep the insert 50 in the tube spout 20. In another embodiment of FIG. 15 the insert 50 may be made out of stainless steel and be held in place in the tube spout 20 by an interference fit. In this embodiment the bottom button 51 may be eliminated.

While certain embodiments of the invention have been described for purposes of illustration, it is to be understood that there may be various embodiments and modifications within the general scope of the invention.

We claim:

1. In a pull-out spray head faucet or hand shower comprising a tube spout and a pull-out spray head removably disposed in said handle, a portion of said adapter extending rearwardly out of and beyond the handle of said pull-out spray head, said adapter having a pair of outwardly extending wings on an outer wall forming said rearwardly extending portion, the improvement comprising a substantially tubular insert being disposed in said tube spout, said insert having a pair of tabs on inner wall having a bearing surface engaged with said wings to bias said adapter toward one side of said insert and thereby reduce wobble of said pull-out spray head when it is inserted into said tube spout.

2. The pull-out spray head faucet of claim 1 wherein said insert has a button on the bottom thereof which engages an aperture in the bottom of said tube spout thereby keeping said insert in position.

3. The pull-out spray head faucet of claim 1 wherein said tabs are angled.

4. The pull-out spray head of claim 3 wherein said insert has a tab extension on the top rear thereof.

5. The pull-out spray head of claim 1 wherein said insert has a tab extension on the top rear thereof.

6. The pull-out spray head of claim 1, wherein said insert is shaped and sized to fit into said tube spout.

7. The pull-out spray head of claim 1, wherein said insert has a substantially elliptical cross-section.

8. The pull-out spray head of claim 1 wherein the insert is comprised of stainless steel.

9. The pull-out spray head of claim 8 wherein there is an interference fit between the insert and the tube spout.

10. The pull-out spray head of claim 1, wherein said adapter includes first and second o-rings disposed about a circumference of said adapter and compressed between said adapter and said inner wall of said insert.

11. The pull-out spray head of claim 10, wherein said bearing surfaces bias said wings and said adapter to unevenly compress said o-rings about said circumference of said adapter.

12. The pull-out spray head of claim 11, wherein compressive forces are greater on a portion of said o-ring below said wings than on a portion of said o-ring above said wings.

13. The pull-out spray head of claim 1, wherein said bearing surfaces are disposed perpendicular to said inner wall of said insert.

14. The pull-out spray head of claim 1, wherein each of said bearing surfaces are disposed on a common plane.

15. The pull-out spray head of claim 1, wherein said bearing surfaces are angled to increase bias as said adaptor is inserted into said tube spout.

16. The pull-out spray head of claim 1, wherein said bearing surfaces are in line contact with said wings.

* * * * *